United States Patent [19]

Johnson

[11] 4,010,507

[45] Mar. 8, 1977

[54] RIDING ATTACHMENT TO FLOOR BUFFER MACHINE

[75] Inventor: Ruben M. Johnson, Courtland, Kans.

[73] Assignee: The Raymond Lee Organization, Inc., New York, N.Y. ; a part interest

[22] Filed: July 14, 1975

[21] Appl. No.: 595,513

[52] U.S. Cl. ..... 15/49 R; 15/246; 280/32.7

[51] Int. Cl.[2] ..... A47L 11/162

[58] Field of Search ..... 15/49 R, 49 C, 49 RB, 15/50 R, 50 A, 50 C, 79 R, 79 A, 82, 83, 98, 246; 280/32.7

[56] References Cited

UNITED STATES PATENTS

| | | | |
|---|---|---|---|
| 765,846 | 7/1904 | Kiner | 280/32.7 |
| 2,218,064 | 10/1940 | Amsbury | 280/32.7 |
| 3,190,672 | 6/1965 | Swanson et al. | 280/32.7 |

*Primary Examiner*—Edward L. Roberts
*Attorney, Agent, or Firm*—Howard I. Podell

[57] ABSTRACT

A wheeled attachment frame assembly that fits onto a floor buffer machine which permits the rider to ride, in a seated position, and to steer the buffer in any direction by the application of pressure on a handle of the buffer or on a foot pedal of the yoke assembly. The attachment frame assembly is formed of a pair of wheels mounted to a vertical seat support and to the rear of a horizontal pull bar, with the front of the pull bar joined to a U-shaped yoke member that is pivotably fastened to a bracket on each side of the top of the housing of the buffer. A transverse bar is mounted on the pull bar and formed on each side of the pull bar as a foot pedal rest. The floor buffer machine to which the unit is attached embodies a buffing wheel mounted in a horizontal plane above the floor surface to be buffed, enclosed by the housing to which a handle is fixed, and driven by an attached electric motor in the housing. The rider, seated on the attached frame controls the direction of the buffer by applying force in either an upward or downward direction on the handle of the buffer so as to rotate the plane of the revolving buffing wheel. With a buffing wheel revolving in a counter-clockwise direction, as seen from above, an upward force on the handle tilts the buffer so that it veers to the right and a downward force acts to steer the buffer to the left. Similarly shifting of the weight of the rider to the left pedal and left side of the handle causes the buffer to go forward, with similar shifts of the rider's weight to the right causing the buffer to go backwards.

1 Claim, 4 Drawing Figures

RIDING ATTACHMENT TO FLOOR BUFFER MACHINE

SUMMARY OF THE INVENTION

My invention is a wheeled attachment frame assembly that fits onto a floor buffer machine which permits the rider to ride, in a seated position, and to steer the buffer in any direction by application of pressure on a handle of the buffer or on a foot pedal of the yoke assembly.

The attachment frame assembly is formed of a pair of wheels mounted to a vertical seat support and to the rear of a horizontal pull bar, with the front of the pull bar joined to a U-shaped yoke member that is pivotably fastened to a bracket on each side of the top of the housing of the buffer.

A transverse bar is mounted on the pull bar and formed on each side of the mill bar as a foot pedal rest.

The floor buffer machine to which the unit is attached embodies a buffing wheel mounted in a horizontal plane above the floor surface to be buffed, enclosed by the housing to which a handle is fixed, and driven by an attached electric motor in the housing.

The rider, seated on the attached frame controls the direction of the buffer by applying force in either an upward or downward direction on the handle of the buffer so as to rotate the plane of the revolving buffing wheel.

With a buffing wheel revolving in a counter-clockwise direction, as seen from above, an upward force on the handle tilts the buffer so that it veers to the right and a downward force acts to steer the buffer to the left.

Similarly shifting of the weight of the rider to the left pedal and left side of the handle causes the buffer to go forward, with similar shifts of the rider's weight to the right causing the buffer to go backwards.

The rider can readily buff a large floor such as the floor of a gymnasium without leaving the seat of the device and at all times can control the direction in which the machine proceeds.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
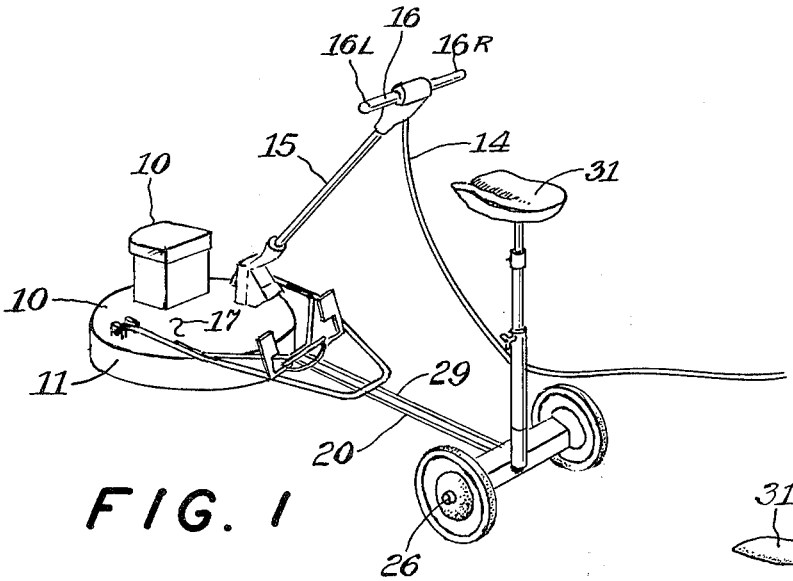
FIG. 1 is a perspective view of the invention installed for use.
Figure 2:
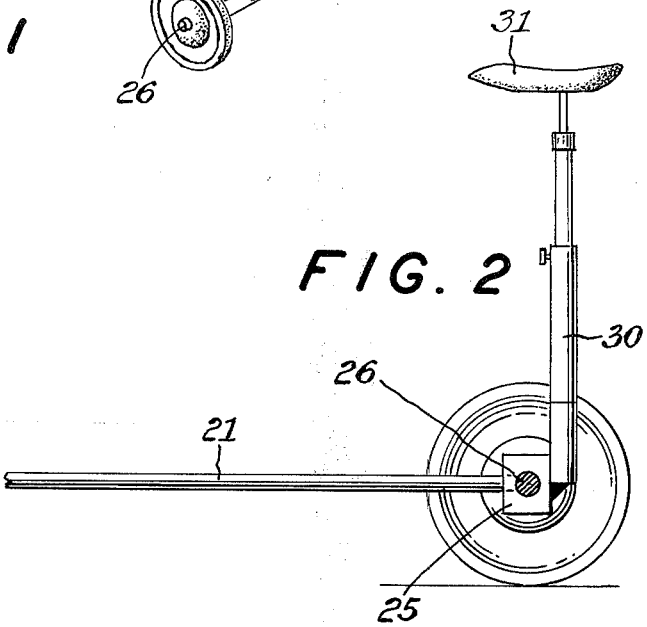
FIG. 2 is a side view of the seat and wheel section of the invention.
Figure 3:
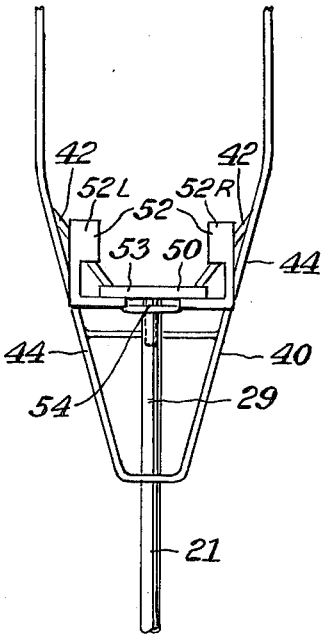
FIG. 3 is a plan view of the yoke section of the invention.
Figure 4:
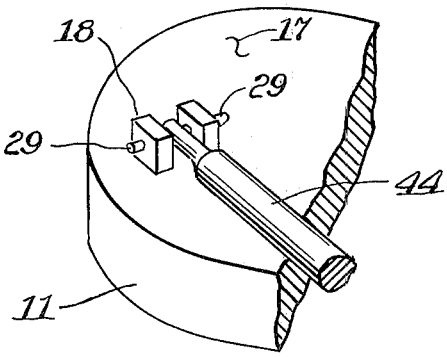
FIG. 4 is a fragmentary perspective view of the mounting bracket and hinged attachment.

Turning now descriptively to the drawings, in which similar reference characters denote similar elements throughout the several views, FIG. 1 illustrates a motorized floor buffing machine 10 to which the frame 20 is attached so that a person seated on the seat 31 of the attached frame 20 may be readily guide the buffing machine 10 in any direction over a floor to be buffed.

Buffing machine 10 is in the form of a circular housing 11 enclosing a buffing wheel rotated in the generally horizontal plane by an electric motor powered by a flexible line cord 14. A handle 15 fitted with handlebar 16 is fixed to the top plate 17 of the housing for conventional use of the machine 10.

The frame 20 is in the form of a tow bar 21 mounted at its rear to a vertical seat support member 30 and to a bearing block 25 in which a wheel axle shaft 26 is mounted. A wheel 27 is mounted to each end of axle shaft 26.

The forward section 29 of tow bar 21 is welded to a yoke section 40. A pedal bar assembly 50 is fastened to the forward end of the tow bar 21 to rest on a brace member 42 of the yoke section 40.

The yoke section 40 is formed of a U-shaped frame 44 welded at its mid-section to the tow bar 21, with each end of the frame 44 pivotably fastened in a bracket 18 fitted to the exterior of the top plate 17 of the buffing machine, to permit vertical rotation of yoke section 40 about brackets 18.

Both brackets 18 are located preferably along a center line of the buffing machine rotatable wheel so that upward or downward pressure by a rider seated in seat 31 against handlebars 16 will tend to tilt the housing 11 with respect to the horizontal plane about the line of pivot pins 29 in brackets 18.

Such tilting of the housing 11 causes greater pressure to be applied by a segment of the rotating buffing wheel to the floor being buffed with consequent tangential motion of the housing resulting with respect to the section of the buffing wheel against which the increased pressure is applied. Thus, with the buffing wheel rotating in a counter-clockwise direction as seen from above, upward pressure on the handle bar 16 to rotate housing about bracket pins 29 causes the machine to swing to the right, with downward applied pressure to handlebar 16 causing the machine to steer to the left.

Pedal bar assembly 50 is formed of a pair of pedals 52, each welded to a transverse bar 53 which is fastened to a longitudinal bar 54 that fits into the open forward end of tow bar 21 and rests on brace members 42 that join the tow bar 21 to the yoke section frame 44.

The user, seated on seat 31, by applying greater pressure to the left pedal 52L and left handlebar 16L than to the right pedal 52R and right handlebar 16R causes the buffing machine to go fowards, with the reverse action causing the machine to travel backwards.

Seat 31 is mounted to tubular member 38 telescopically mounted to vertical support member 30 for purposes of height adjustment.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. For use in combination with a circular rotatable wheel buffing machine which comprises a housing enclosing a motorized buffing wheel which rotates in a horizontal plane about a vertical axis in the normal position of said machine, an attachment comprising a U-shaped yoke frame, said frame terminating in two spaced legs, said legs being pivotably fastened to the housing of the buffing machine on opposed horizontal sides of the vertical axis of rotation of the buffing wheel, a tow bar having a front end and a rear end, said bar being fixed at said front end to said frame, said rear end of said tow bar being supported by wheel means, and a vertical seat support structure mounted on said rear end of said tow bar.

* * * * *